US007025382B2

(12) United States Patent
Wiggins

(10) Patent No.: US 7,025,382 B2
(45) Date of Patent: Apr. 11, 2006

(54) INDEX TAB LABELING SYSTEM FOR SUSPENDED FILE FOLDER

(76) Inventor: Joey Martin Wiggins, 118 Water Oak Dr., Searcy, AR (US) 72143

( * ) Notice: Subject to any disclaimer, the term of this patent is extended or adjusted under 35 U.S.C. 154(b) by 21 days.

(21) Appl. No.: 10/828,645

(22) Filed: Apr. 21, 2004

(65) Prior Publication Data

US 2005/0236831 A1 Oct. 27, 2005

(51) Int. Cl.
*A47B 63/00* (2006.01)

(52) U.S. Cl. ..... 283/36; 283/37; 283/39; 283/41; 283/81; 283/101; 229/67.1; 229/67.2; 40/641; 40/359; 428/40.1; 428/42.1

(58) Field of Classification Search ..... 283/36, 283/37, 39, 41, 81, 101; 229/67.1, 67.2; 40/641, 359; 428/40.1, 42.1
See application file for complete search history.

(56) References Cited

U.S. PATENT DOCUMENTS

| | | | | |
|---|---|---|---|---|
| 2,312,717 | A | 3/1943 | Jonas | |
| 2,507,659 | A * | 5/1950 | Zalkind | 40/641 |
| 3,054,202 | A * | 9/1962 | Scholfield | 40/641 |
| 3,238,947 | A * | 3/1966 | Churnick | 211/162 |
| 3,244,179 | A * | 4/1966 | Porteous et al. | 211/162 |
| 4,053,057 | A | 10/1977 | Snowden | |
| 5,195,265 | A | 3/1993 | Klingenberg | |
| 5,361,904 | A | 11/1994 | Kapec et al. | |
| 5,503,487 | A * | 4/1996 | Ong | 402/79 |
| 5,597,634 | A | 1/1997 | Bloomer et al. | |
| 5,641,550 | A * | 6/1997 | Berman et al. | 428/40.9 |
| 5,910,349 | A | 6/1999 | Tsukuda | |
| 5,953,843 | A * | 9/1999 | Collins et al. | 40/641 |
| 6,063,225 | A | 5/2000 | Riordan | |
| 6,132,831 | A * | 10/2000 | Thomas-Cote | 428/43 |
| 6,332,285 | B1 * | 12/2001 | Aaldenberg et al. | 40/641 |
| 6,475,585 | B1 * | 11/2002 | Yamanashi et al. | 428/40.1 |
| 2003/0066219 | A1 * | 4/2003 | Palumbo | 40/359 |
| 2004/0040649 | A1 * | 3/2004 | Bratter | 156/249 |

* cited by examiner

*Primary Examiner*—Boyer Ashley
*Assistant Examiner*—Mark Henderson
(74) *Attorney, Agent, or Firm*—Ray F. Cox, Jr.

(57) ABSTRACT

An index tab labeling system for use with suspended file folder of the type having vertical slots along an upper margin, the labeling system comprising a flexible index tab having a single layer of flexible material with lugs for insertion into the vertical slots in the file folder. A pad of labels is affixed to the index tab by a releasable adhesive. The pad of labels has multiple labels which are held to each other by releasable adhesive. The user may write index information on the uppermost label and when the index information requires changing, the uppermost label may be peeled off and the next label is made available for index information to be entered thereon. A pad of three labels is considered to be optimum. When all the labels in one pad are used, a new pad of labels may be releasably adhered to the index tab. In an alternative embodiment, each of the labels may be supplied with a portion that does not have a releasable adhesive applied to it. This allows each label to be more easily grasped and removed when a label requires replacement.

7 Claims, 2 Drawing Sheets

INDEX TAB LABELING SYSTEM FOR SUSPENDED FILE FOLDER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to suspended file folders of the type disclosed in U.S. Pat. No. 4,053,057 to Snowden, and in particular to a labelng system for use with such file folders. As described in the Snowden patent, flexible plastic index tabs are formed with resilent lugs which are sprung into spaced vertical slots along the top margin of the file folder. The index tabs are formed by folding over the front and back portions so that a label may be inserted inbetween the front and back portions.

The prior art type of labelling system is inconvenient to use in that labels must be inserted into the space between the front and back portions of the index tab, which can be time consuming and annoying. Likewise, labels may require changing to reflect the changing contents of the file folder or to allow the folder to be reused for a different purpose. Changing labels requires the old label to be removed from the index tab (a difficult task in itself), which often necessitates removing the index tab from the folder before the new label can be inserted and the index tab reinstalled in the file folder. In addition to the inconvenience and inefficiency involved in changing the index information on a file folder, the prior art system also suffers from a tendency for the labels to fall out of the index tab and become lost.

It is therefore desirable to have a labeling system that is more convenient and efficient to use, particularly as to file folders which require the changing or updating of index information. The limitations of the prior art are overcome by the present invention as described below.

BRIEF SUMMARY OF THE INVENTION

In the present invention, the index tab is preferably a single layer of resilient material with lugs for insertion into the spaced vertical slots in the file folder. A pad of labels is affixed to the upper portion of the index tab by a releasable adhesive. The pad has a plurality of labels which are held to each other by a layer of releasable adhesive on the respective lower surfaces of each label. The user may write or otherwise enter index information on the upper surface of the uppermost label and when the index information requires changing, the uppermost label may be peeled off and the next label is made available for index information to be entered thereon.

A pad of three labels is considered to be optimum. Fewer are less likely to offer the advantages of ease in changing index information, while more may prove inefficient as providing excessive unneeded labels as well as presenting too thick an aspect. When all the labels in one pad are used, a new pad of labels may be releasably adhered to the index tab.

In an alternative embodiment, each of the labels may be supplied with a portion that does not have a releasable adhesive applied to it. This allows each label to be more easily grasped and removed when a label requires replacement.

These and other features, objects and advantages of the present invention will become better understood from a consideration of the following detailed description of the preferred embodiments and appended claims in conjunction with the drawings as described following:

DETAILED DESCRIPTION OF THE INVENTION

With reference to FIGS. 1–4B, the preferred embodiment of the present invention may be described as follows.

Figure 1:
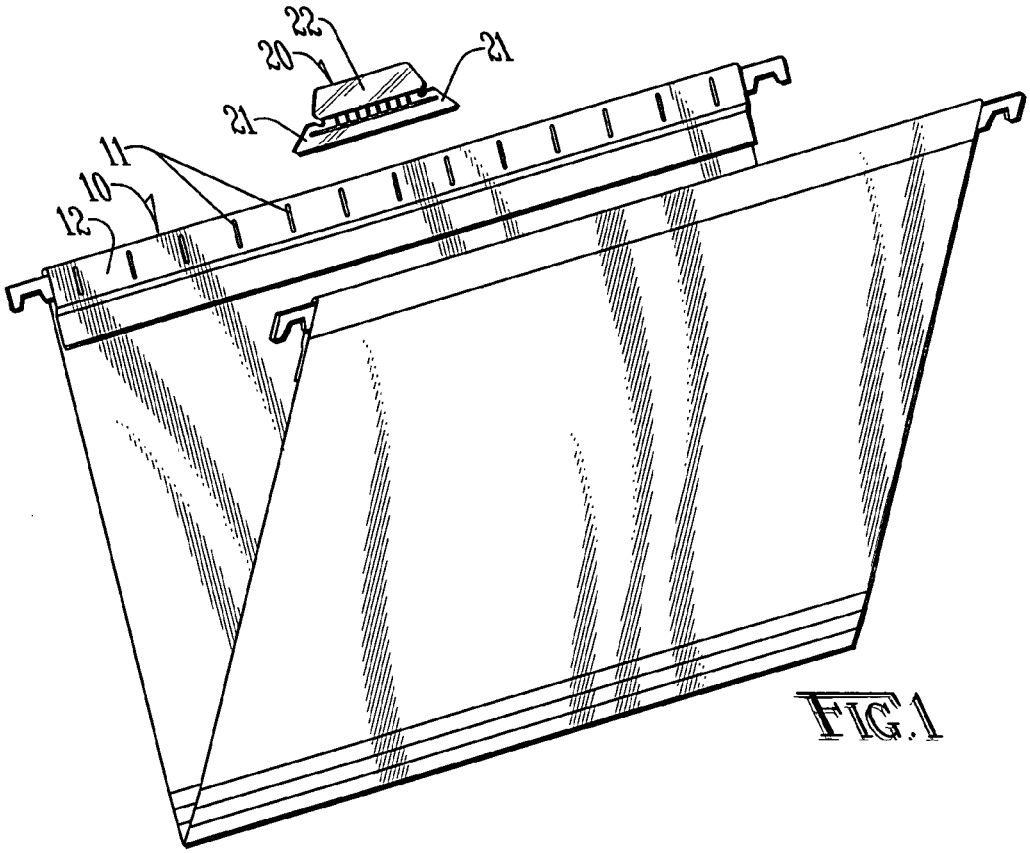
FIG. 1 is a perspective view of a prior art type of suspended file folder with an index tab of the present invention shown in exploded relationship thereto.

FIG. 1 is a perspective view of a suspended file folder 10 having a row of spaced vertical slots 11 along an upper margin 12 of the file folder 10. This is a typical suspended file folder as known in the prior art. Shown in exploded relationship is an index tab 20 of the present invention. The index tab 20 is a single layer of flexible material, such as plastic. The index tab 20 is provided with a pair of flexible lugs 21 adapted for insertion into respective vertical slots 12 in the file folder. The index tab 20 is also provided with a receiving portion 22 having a space for receiving a pad 30 of labels 31 as described below.

Figure 2:
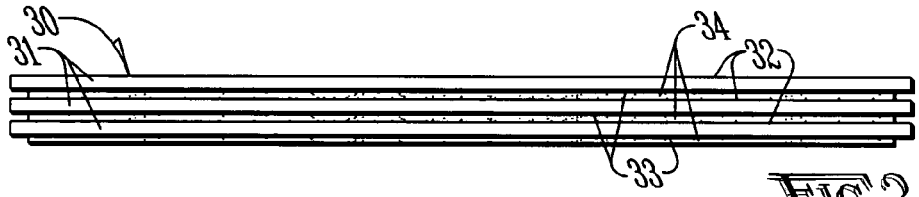
FIG. 2 is a bottom elevation view of a pad of labels of the present invention.
Figure 3:
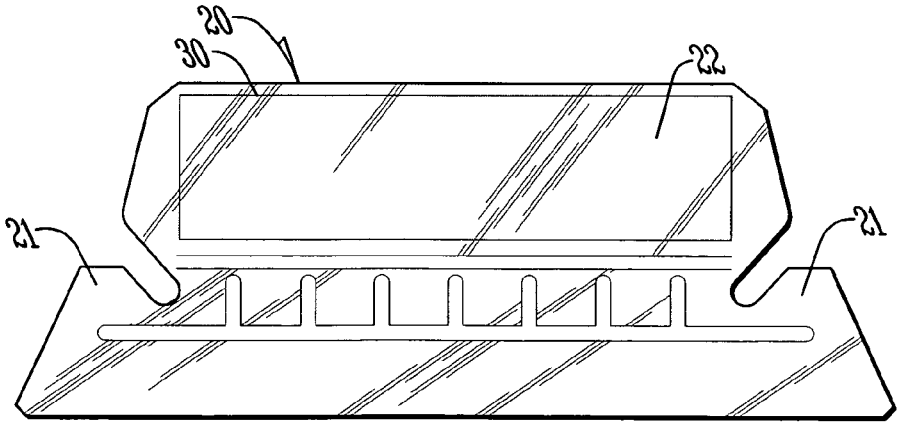
FIG. 3 is a front elevation view of the index tab of the present invention with a pad of labels adhered thereto.

As shown in FIG. 2, the pad 30 comprises a plurality of labels 31 in superimposed relationship. Each label 31 comprises an upper surface 32 adapted to receive index information (which may be printed or typed or otherwise entered upon the upper surface 32) and a lower surface 33 having a layer 34 of releasable adhesive applied thereto. Any of various well-known releasable adhesives may be used in the practice of the present invention, provided that the adhesive allows successive uppermost labels 31 to be peeled from the underlying label 31 without adhering so tightly to the underlying label 31 as to prevent the easy separation of one label 31 at a time from the underlying label 31 or to damage the underlying label 31.

A pad 30 of three labels 31 is considered to be optimum, although the present invention is not limited thereto. A greater or lesser plurality of labels 31 may be desirable in particular applications. The releasable adhesive layer 34 of the lowermost label 31 may be protected by a removable layer of material (not shown) until the pad 30 is adhered to the receiving portion 22 of the index tab 20.

In use, the uppermost label 31 may have index information entered onto its upper surface 32 either before or after the pad 30 is adhered to the index tab 20. When the index information requires changing, the uppermost label 31 is peeled from the next label 31 and the new index information entered thereon. This process continues until the pad 30 is exhausted. A new pad 30 may be adhered to the index tab 20 and the process repeated as often as needed.

Figure 4A:
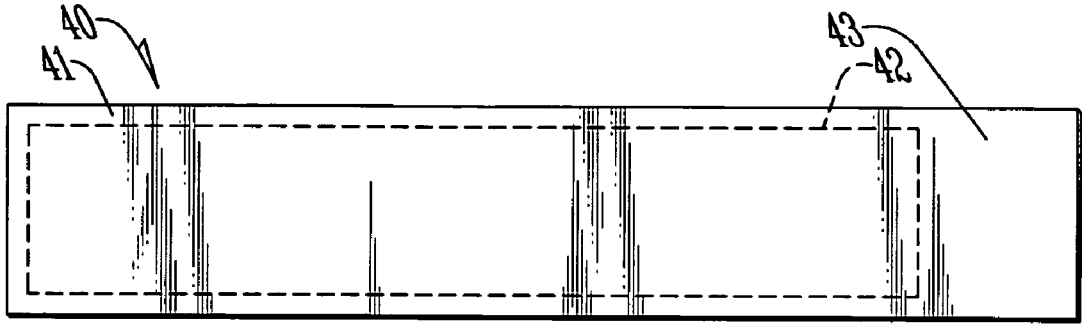
FIG. 4A is a plan view of an alternative embodiment of a pad of labels having a non-adhesive portion.
Figure 4B:
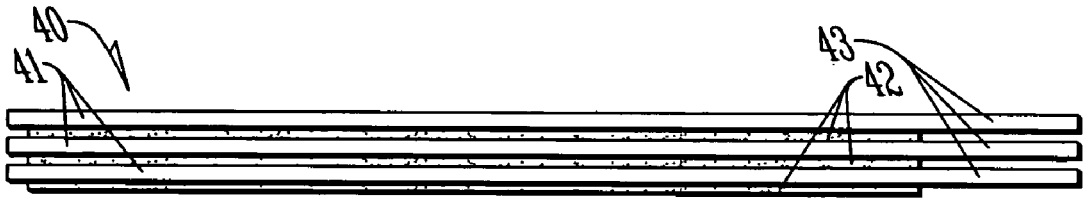
FIG. 4B is a bottom elevation view of the pad of labels of FIG. 4A.

In an alternative embodiment of the present invention as shown in FIGS. 4A and 4B, a pad 40 of labels 41 may be provided with respective layers 42 of releasable adhesive which do not cover the entirety of the respective lower surfaces of the labels 41. Instead, a non-adhesive portion 43 of each label 41 is left without a releasable adhesive allowing for the user to easily grasp the non-adhesive portion 43 to aid in removal of each label 41 in turn.

The present invention has been described with reference to certain preferred and alternative embodiments that are intended to be exemplary only and not limiting to the full scope of the present invention as set forth in the appended claims.

What is claimed is:

1. An index tab labeling system for a suspended file folder of the type having spaced vertical slots along an upper margin, comprising:

at least one flexible index tab having flexible lugs for insertion into the spaced vertical slots; said tab having a space with a periphery; and at least one pad comprising a plurality of labels, each of said labels comprising a sheet having an upper surface for entering information and a lower surface coated with a releasable adhesive, said pad connected to and received within said periphery of said space, said flexible index tab having a space for receiving said pad.

2. The index tab labeling system of claim 1 wherein said pad comprises at least three labels.

3. The index tab labeling system of claim 1 wherein said lower surfaces of said labels comprise a non-adhesive portion.

4. The index tab labeling system of claim 1 wherein said flexible index tab comprises a single sheet of flexible material.

5. An index tab labeling system for a suspended file folder of the type having spaced vertical slots along an upper margin, comprising:

at least one flexible index tab comprising a single sheet of flexible material having flexible lugs for insertion into the spaced vertical slots; said tab having a space with a periphery; and at least one pad comprising at least three labels, each of said labels comprising a sheet having an upper surface for entering information and a lower surface coated with a releasable adhesive, said pad connected to and received within said periphery of said space, said flexible index tab having a space for receiving said pad.

6. The index tab labeling system of claim 5 wherein said lower surfaces of said labels comprise a non-adhesive portion.

7. An index tab labeling system for a suspended file folder of the type having spaced vertical slots along an upper margin, comprising:

at least one flexible index tab comprising a single sheet of flexible material having flexible lugs for insertion into the spaced vertical slots; said tab having a space with a periphery; and at least one pad comprising at least three labels, each of said labels comprising a sheet having an upper surface for entering information and a lower surface comprising a first portion coated with a releasable adhesive and a second non-adhesive portion, said pad connected to and received within said periphery of said space, said flexible index tab having a space for receiving said pad.

* * * * *